US008705782B2

(12) United States Patent
Woods et al.

(10) Patent No.: US 8,705,782 B2
(45) Date of Patent: Apr. 22, 2014

(54) WIRELESS BEACON SYSTEM TO IDENTIFY ACOUSTIC ENVIRONMENT FOR HEARING ASSISTANCE DEVICES

(75) Inventors: William S. Woods, Berkeley, CA (US); Jeffrey Paul Solum, Deephaven, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 343 days.

(21) Appl. No.: 12/388,341

(22) Filed: Feb. 18, 2009

(65) Prior Publication Data

US 2009/0208043 A1 Aug. 20, 2009

Related U.S. Application Data

(60) Provisional application No. 61/029,564, filed on Feb. 19, 2008.

(51) Int. Cl.
*H04R 25/00* (2006.01)

(52) U.S. Cl.
USPC ..... 381/315; 455/68

(58) Field of Classification Search
USPC ..... 455/68; 381/315
See application file for complete search history.

(56) References Cited

U.S. PATENT DOCUMENTS

| | | | | |
|---|---|---|---|---|
| 4,777,474 | A | 10/1988 | Clayton | |
| 6,195,572 | B1 | 2/2001 | Patterson et al. | |
| 6,870,940 | B2 | 3/2005 | Meyer et al. | |
| 2003/0235319 | A1 | 12/2003 | Rass | |
| 2004/0138723 | A1 * | 7/2004 | Malick et al. | 607/57 |
| 2006/0222194 | A1 * | 10/2006 | Bramslow et al. | 381/314 |
| 2007/0237335 | A1 * | 10/2007 | O'Sullivan | 381/63 |
| 2007/0249289 | A1 * | 10/2007 | Grafenberg et al. | 455/68 |
| 2008/0013769 | A1 * | 1/2008 | Sacha et al. | 381/345 |
| 2008/0199971 | A1 | 8/2008 | Tondra | |
| 2009/0184706 | A1 * | 7/2009 | Duric et al. | 324/202 |
| 2009/0196444 | A1 | 8/2009 | Solum | |

FOREIGN PATENT DOCUMENTS

| | | | |
|---|---|---|---|
| EP | 2104378 | B1 | 7/2013 |
| WO | WO-2007046748 | A1 | 4/2007 |
| WO | WO-2008055960 | A1 | 5/2008 |

OTHER PUBLICATIONS

"European Application Serial No. 09250424.0, Examination Notification mailed Feb. 8, 2011", 8 pgs.
"European Application Serial No. 09250424.0, Response filed Dec. 9, 2009 to European Search Report mailed Jun. 4, 2009", 6 pgs.
"European Application Serial No. 09250424.0, EP Search Report Jun. 4, 2009", 8 pgs.
Tondra, Mark, "U.S. Appl. No. 60/887,609, filed Feb. 1, 2007", 28 pgs.
"European Application Serial No. 09250424.0, Response filed Jun. 16, 2011 to Examination Notification mailed Feb. 8, 2011", 12 pgs.

* cited by examiner

*Primary Examiner* — Ken Parker
*Assistant Examiner* — Dale E Page
(74) *Attorney, Agent, or Firm* — Schwegman, Lundberg & Woessner, P.A.

(57) ABSTRACT

A beacon device adapted to wirelessly communicate with a hearing assistance device, the beacon device comprising a sensor to sense a signal related to determination of an acoustic environment, a memory to store information relating to the signal, a processor in communication with the memory and the sensor, the processor adapted to process the information, a wireless transmitter in communication with the memory and an antenna coupled to the wireless transceiver to transmit information to the hearing assistance device.

27 Claims, 6 Drawing Sheets

| 510 | 520 | |
|---|---|---|
| 512 CODE 1 | ACOUSTIC ENVIRONMENT 1<br>E.G. INSIDE A CAR | 522 |
| 514 CODE 2 | ACOUSTIC ENVIRONMENT 2<br>E.G. IN A ROOM WHILE VACUUMING | 524 |
| 516 CODE 3 | ACOUSTIC ENVIRONMENT 3<br>E.G. IN AN OPEN SPACE | 526 |
| ⋮ | ⋮ | |
| 518 CODE N | ACOUSTIC ENVIRONMENT N<br>E.G. IN A LECTURE HALL | 528 |

*Fig. 5*

WIRELESS BEACON SYSTEM TO IDENTIFY ACOUSTIC ENVIRONMENT FOR HEARING ASSISTANCE DEVICES

RELATED APPLICATION AND CLAIM OF PRIORITY BENEFIT

This application claims the benefit under 35 U.S.C. 119(e) to U.S. Provisional Patent Application Ser. No. 61/029,564 filed Feb. 19, 2008 which is incorporated herein by reference in its entirety.

FIELD OF TECHNOLOGY

This document relates to hearing assistance devices and more particularly method and apparatus for a wireless beacon system to identify acoustic environment for hearing assistance devices.

BACKGROUND

Hearing assistance devices, such as hearing aids, can provide adjustable operational modes or characteristics that improve the performance of the hearing assistance device for a specific person or in a specific environment. Some of the operational characteristics include, but are not limited to volume control, tone control, directionality, and selective signal input. These and other operational characteristics can be programmed into a hearing aid. Advanced hearing assistance devices, such as digital hearing aids, may be programmed to change from one operational mode or characteristic to another depending on algorithms operating on the device. As the person wearing a hearing assistance device moves between different acoustic environments, it may be advantageous to change the operational modes or characteristics of the hearing assistance device to adjust the device to particular acoustic environments. Some devices may possess signal processing adapted to classify the acoustic environments in which the hearing assistance device operates. However, such signal processing may require a relatively large amount of signal processing power, be prone to error, and may not yield sufficient improvement in cases when processing power is available. Certain environments may be more difficult to classify than others and can result in misclassification of the environment or frequent switching of the detected environment, thereby resulting in reduced hearing benefits of the hearing assistance device. One problematic environment is that of a vehicle, such as an automobile. Wearers of digital hearing aids in moving vehicles are exposed to a variety of sounds coming from the vehicle, open windows, fans, and sounds from outside of the vehicle. Users may experience frequent mode switching from adaptive devices as they attempt to adjust rapidly to changing acoustic environmental inputs.

There is a need in the art for an improved system for determining acoustic environments in hearing assistance devices.

SUMMARY

This document provides methods and apparatus to provide environment awareness in hearing assistance devices. In one embodiment, a wireless beacon is provided acoustic environment information, the beacon including a memory to store one more acoustic environment codes identifying one or more acoustic environments, a wireless transmitter coupled to the memory and an antenna coupled to the wireless transceiver to transmit the one or more acoustic environment codes to a hearing assistance device.

In one embodiment, a beacon device is provided for wirelessly communicating with a hearing assistance device. The beacon device includes a sensor to sense a signal related to determination of an acoustic environment, a memory to store information relating to the signal, a processor in communication with the memory and the sensor, the processor adapted to process the information, a wireless transmitter in communication with the memory and an antenna coupled to the wireless transceiver to transmit information to the hearing assistance device.

In one embodiment, a method is provided for controlling operation of a hearing assistance device. The method includes storing one or more acoustic environment codes in a beacon device, the one or more acoustic environment codes identifying one or more acoustic environments, transmitting an acoustic environment code of the one or more acoustic environment codes to a hearing assistance device and adjusting an operational mode of the hearing assistance device based on the acoustic environment code.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their legal equivalents.

BRIEF DESCRIPTION OF THE DRAWINGS

FIG. 5 illustrates a table showing various acoustic environment codes, according to one embodiment of the present subject matter.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
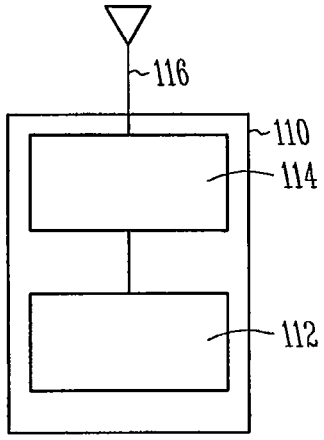
FIG. 1 illustrates a block diagram of a wireless beacon device according to one embodiment of the present subject matter.

FIG. 1 illustrates a wireless beacon device 110 according to one embodiment of the present subject matter. The illustrated beacon device 110 includes a memory 112, a transmitter 114 and an antenna 116. In the illustrated embodiment, the memory 112 and antenna 116 are coupled to transmitter 114. In various embodiments, one or more conductors are used as an antenna 116 for electronic wireless communications. When driven by the transmitter 114, the antenna 116 converts electrical signals into electromagnetic energy and radiates electromagnetic waves for reception by other devices. In various embodiments, the antenna 166 is implemented in different configurations. In one embodiment, antenna 166 is a monopole. In one embodiment, antenna 166 is a dipole. In one embodiment, antenna 166 is a patch antenna. In one embodiment, antenna 166 is a flex antenna. In one embodiment, antenna 166 is a loop antenna. In one embodiment, antenna 166 is a waveguide antenna. In various embodiments, the wireless beacon device 110 includes a processor. In various embodiments the processor is a microprocessor. In various embodiments the processor is a digital signal processor. In various embodiments the processor is microcontroller. Other processors may be used without departing from the scope of the present subject matter. Other antenna configurations are possible without departing from the scope of the present subject matter.

In various embodiments, the beacon device includes one or more sensors. In one embodiment, the sensor is an accelerometer. In one embodiment, the sensor is a micro-electromechanical system (MEMS) accelerometer. In one embodiment, the sensor is a magnetic sensor. In one embodiment, the sensor is a giant magnetorestrictive (GMR) sensor. In one embodiment the sensor is an anisotropic magnetorestrictive (AMR) sensor. In one embodiment the sensor is a microphone. In various embodiments, a combination of sensors are employed, including, but not limited to those stated in this disclosure. In various embodiments signal processing circuits capable of processing the sensor outputs are included. In various embodiments, a processor is included which processes signals from the one or more sensors. In various embodiments, the processor is adapted to determine the acoustic environment based on data from at least one of the one or more sensors. In such embodiments, environment information is sent wirelessly to one or more hearing assistance devices. In various embodiments, the beacon device sends the sensor data wirelessly. In such embodiments, one or more hearing assistance devices can receive the data and process it to identify an acoustic environment. In various embodiments, the beacon may act as a remote sensor to the one or more hearing assistance devices. The information from the beacon can be used exclusively, selectively, or in combination with audio information from the hearing assistance device to determine an acoustic environment. Other sensors and applications are possible without departing from the scope of the present subject matter.

In various embodiments, memory 112 stores one or more acoustic environment codes that identify one or more particular acoustic environments. Transmitter 114 is configured to transmit the one or more acoustic environment codes stored in memory 112 at uniform intervals. In one embodiment, the transmitter 114 is adapted to detect the presence of a hearing assistance device and initiate transmission of one or more acoustic environment codes stored in memory 112. In various embodiments, memory 112 includes non-volatile flash memory. In various embodiments, memory 112 includes a DRAM (Dynamic Random Access Memory). In various embodiments, memory 112 includes an SRAM (Static Random Access Memory). In various embodiments, memory 112 stores sensor signal information from one or more sensors. In various embodiments, such sensor signal information is telemetered using transmitter 114. In various embodiments, such sensor signal information is processed before it is transmitted. Other techniques and apparatus may be employed to provide the memory. For example, in one embodiment, the code is hardwired to provide the memory used by transmitter 114.

In various embodiments, beacon device 110 is attached to devices to assist the hearing assistance device in determining the appropriate processing required by the hearing assistance device. For example, a beacon device 110 could be attached to a user's television, and the hearing assistance device would automatically switch to a "television" mode when the television is powered on (thus activating the TV beacon). In various embodiments, the hearing assistance device switches to a predetermined mode when it senses various coded beacon devices in range. In various embodiments, beacon devices could be attached to noisy consumer devices such as a vacuum cleaner, which can change noise reduction more accurately and quickly then when compared to having to detect such consumer devices solely based on their acoustic signature. In various embodiments, beacon devices could be configured to automatically terminate transmission of acoustic environment codes when the consumer device (such as a television, vacuum cleaner, etc.) is turned off.

Figure 2:
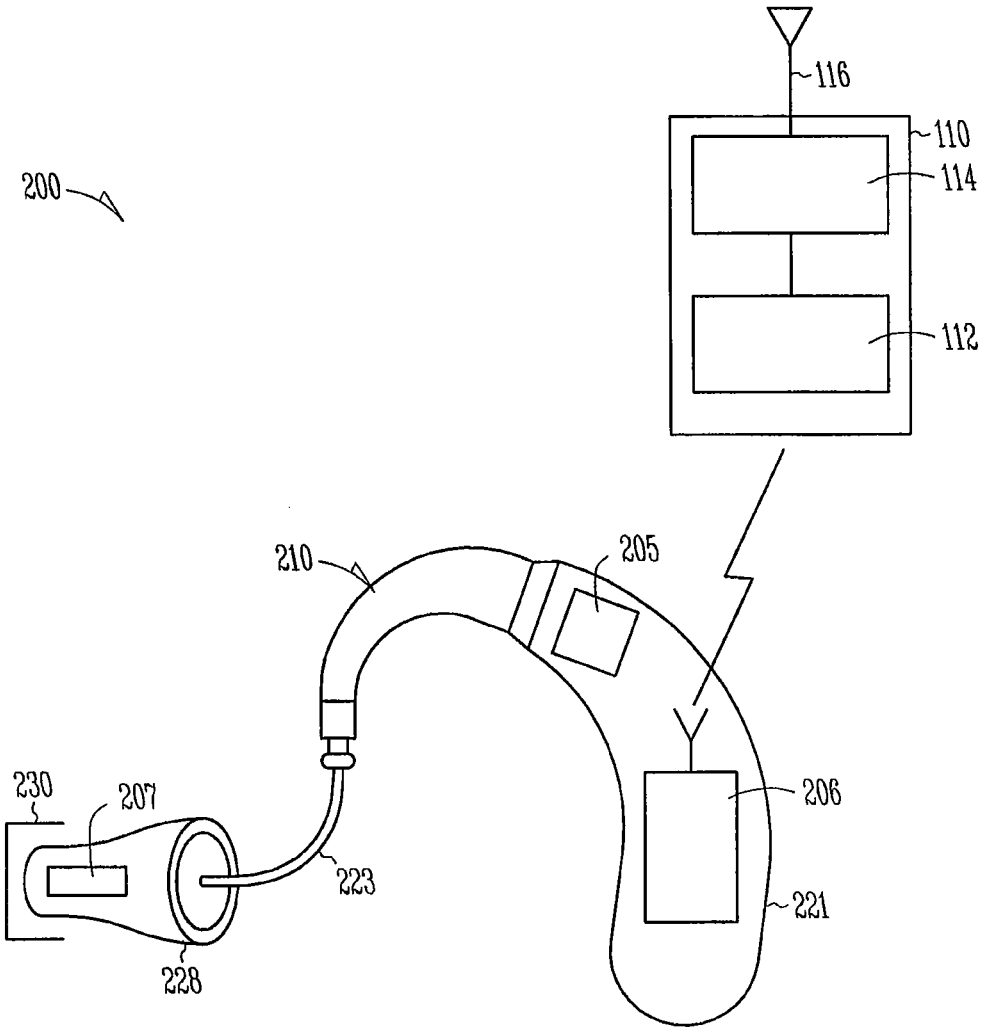
FIG. 2 illustrates a wireless beacon system, according to one embodiment of the present subject matter.

FIG. 2 illustrates a wireless beacon system 200, according to one embodiment of the present subject matter. FIG. 2 demonstrates one embodiment with a receiver in the canal (RIC) design, it is understood that other types of hearing assistance devices may be employed without departing from the scope of the present subject matter. The illustrated system 200 shows the beacon device 110 in wireless communication with a hearing assistance device 210. In various embodiments, the hearing assistance device 210 includes a first housing 221, a second housing 228 and a cable assembly 223 that includes conductors, which connect electrical components such as hearing assistance electronics 205 enclosed in the first housing 221 to electrical components such as speaker (also known as a "receiver" as used in hearing aid parlance) 207 enclosed within second housing 228. In one embodiment, first housing 221 includes signal processing electronics in communication with the wireless receiver 206 to perform various signal processing depending on one or more beacon signals detected by wireless receiver 206. In various embodiments, at least one of the first housing 221 and the second housing 228 includes at least one microphone to capture the acoustic waves that travel towards a user's ears. In the illustrated embodiment, the first housing 221 is adapted to be worn on or behind the ear of a user and the second housing 228 is adapted to be positioned in an ear canal 230 of the user. In various embodiments, one or more of the conductors in the cable assembly 223 can be used as an antenna for electronic wireless communications. Some examples of such embodiments are found in, but not limited to, U.S. patent application Ser. No. 12/027,151, entitled ANTENNA USED IN CONJUNCTION WITH THE CONDUCTORS FOR AN AUDIO TRANSDUCER, filed Feb. 6, 2008, the entire disclosure of which is incorporated by reference in its entirety. In various embodiments, the cable assembly 223 may include a tube, protective insulation or a tube and protective insulation. In various embodiments, the cable assembly 223 is formable so as to adjust the relative position of the first and second housing according to the comfort and preference of the user.

In various embodiments, such as in behind-the-ear devices, hearing assistance electronics 205 is in communications with a speaker (or receiver, as is used commonly in hearing aids) in communication with electronics in first housing 221. In such embodiments, a hollow sound tube is used to transmit sound from the receiver in the behind-the-ear or over-the-ear device to an earpiece 228 in the ear. Thus, in the BTE application, BTE housing 221 is connected to a sound tube 223 to provide sound from the receiver to a standard or custom earpiece 228. In such BTE designs, no receiver is found in the earpiece 228.

In various embodiments, beacon device 110 transmits an acoustic environment code identifying an acoustic environment. In various embodiments, the wireless receiver 206 in the hearing assistance device 210 receives the acoustic environment codes transmitted by the beacon device 110. In various embodiments, upon receiving the acoustic environment code, the wireless receiver 206 sends the received acoustic environment code to hearing assistance electronics 205. In various embodiments, sensor information is transmitted by the beacon device 110 to hearing assistance device 210 and the information is processed by the hearing assistance device. In various embodiments, the processing includes environment determination. In various embodiments, the information transmitted includes sensor based information. In various embodiments, the information transmitted includes statistical information associated with sensed information.

In various embodiments the hearing assistance electronics 205 can be programmed to perform a variety of functions depending on a received code. Some examples include, but are not limited to, configuring the operational mode of the at least one microphone, adjusting operational parameters, adjusting operational modes, and/or combinations of one or more of the foregoing options. In various embodiments, the operating mode of the microphone is set to directional mode based on the received acoustic environment code that identifies a particular acoustic environment (eg., acoustic environment where the user is listening to fixed speaker in a closed room), if the wearer would benefit from a directional mode setting for a better quality of hearing. In various embodiments, the operating mode of the microphone is set to an omni-directional mode based on the received acoustic environment code. For example, if the user is listening to natural sounds in an open field, the microphone setting can be set to omni-directional mode for providing further clarity of the acoustic waves received by the hearing assistance device 210. In various embodiments, where there is more than one microphone, the operating mode of a first microphone can be set to a directional mode and the operating mode of a second microphone can be set to an omni-directional mode based on the acoustic environment code received from the beacon device 110.

In various embodiments, the first housing 221 is a housing adapted to be worn on the ear of a user, such as, an on-the-ear (OTE) housing or a behind-the-ear (BTE) housing. In various embodiments, the second housing 228 includes an earmold. In various embodiments, the second housing 228 includes an in-the-ear (ITE) housing. In various embodiments, the second housing 228 includes an in-the-canal (ITC) housing. In various embodiments, the second housing 228 includes a completely-in-the-canal (CIC) housing. In various embodiments the second housing 228 includes an earbud. In various embodiments, the receiver 207 is placed in the ear canal of the wearer using a small nonocclusive housing. Other earpieces are possible without departing from the scope of the present subject matter.

Figure 3:
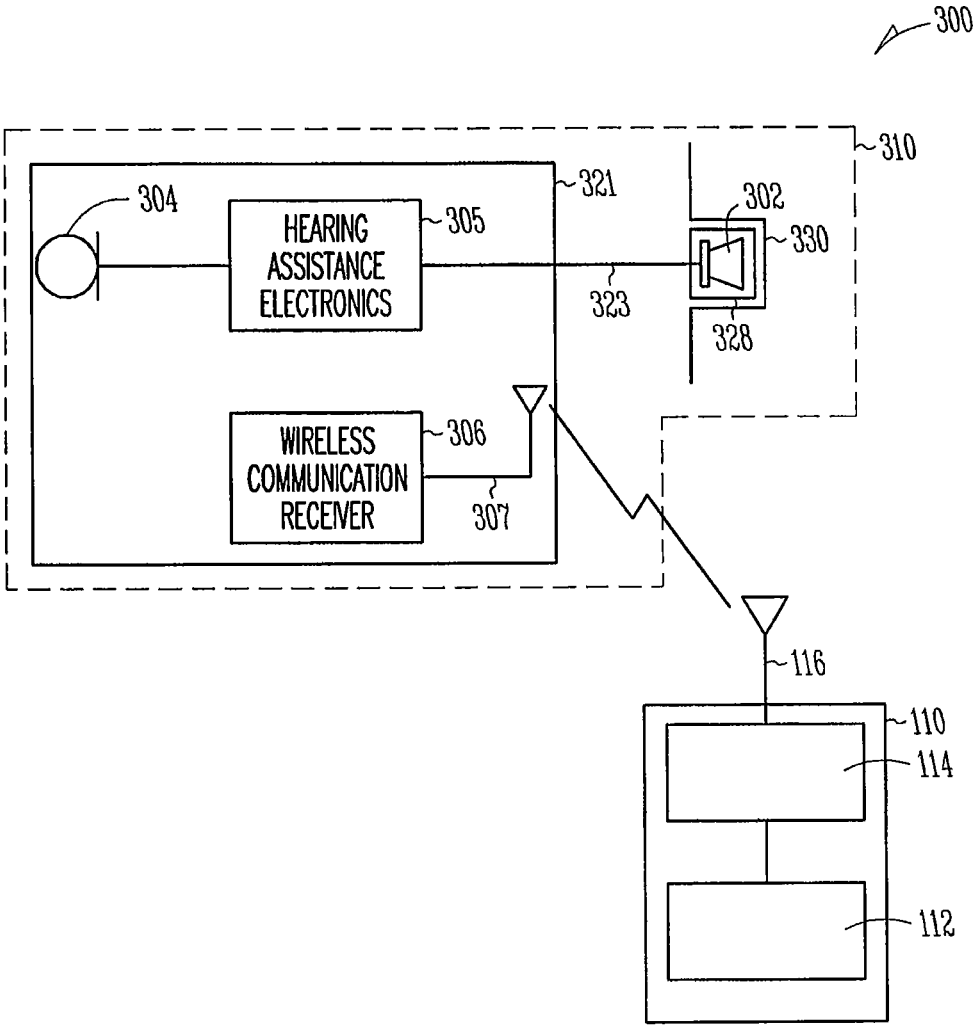
FIG. 3 illustrates a block diagram of a wireless beacon system including a hearing assistance device, according to one embodiment of the present subject matter.

FIG. 3 illustrates a block diagram of a system 300, according to the present subject matter. The illustrated system 300 shows the beacon device 110 in wireless communication with a hearing assistance device 310. In various embodiments, the hearing assistance device 310 includes a first housing 321, an acoustic receiver or speaker 302, positioned in or about the ear canal 330 of a wearer and conductors 323 coupling the receiver 302 to the first housing 321 and the electronics enclosed therein. The electronics enclosed in the first housing 321 includes a microphone 304, hearing assistance electronics 305, a wireless communication receiver 306 and an antenna 307. In various embodiments, the hearing assistance electronics 305 includes at least one processor and memory components. The memory components store program instructions for the at least one processor. The program instructions include functions allowing the processor and other components to process audio received by the microphone 304 and transmit processed audio signals to the speaker 302. The speaker emits the processed audio signal as sound in the user's ear canal. In various embodiments, the hearing assistance electronics includes functionality to amplify, filter, limit, condition or a combination thereof, the sounds received using the microphone 304.

In the illustrated embodiment of FIG. 3, the wireless communications receiver 306 is connected to the hearing assistance electronics 305 and the conductors 323 connect the hearing assistance electronics 305 and the speaker 302. In various embodiments, the hearing assistance electronics 305 includes functionality to process acoustic environment codes or sensor related information received from a beacon device 110 using the antenna 307 that is coupled to the wireless communications receiver 306.

Figure 4:
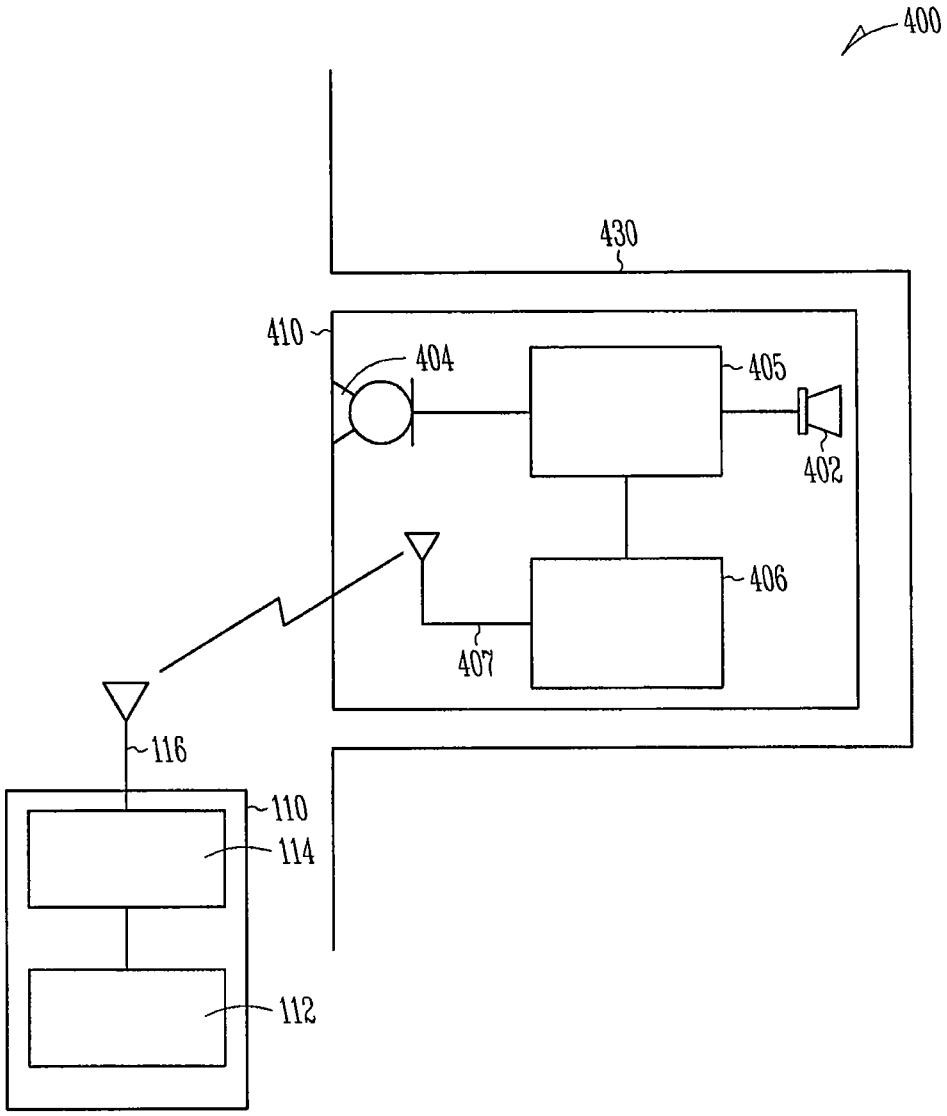
FIG. 4 illustrates a block diagram of a wireless beacon system including a hearing assistance device adapted to work in a user's ear having a wireless communications transmitter, according to one embodiment of the present subject matter.

FIG. 4 illustrates a block diagram of a system 400, according to the present subject matter. The illustrated system 400 shows the beacon device 110 in wireless communication with a hearing assistance device 410 placed in or about an ear canal 430. In various embodiments, the hearing assistance device 410 includes a speaker 402, a microphone 404, hearing assistance electronics 405, a wireless communication receiver 406 and antenna 407. It is understood that the hearing assistance device shown in FIG. 4 includes, but is not limited to, a completely-in-the-canal device, and an in-the ear device. Other devices may be in communication with beacon device 10 without departing from the scope of the present subject matter.

FIG. 5 illustrates a table 500 showing various acoustic environment codes, according to the present subject matter. The illustrated table 500 includes columns 510 and 520 representing acoustic environment codes and acoustic environments, respectively. In various embodiments, table 500 includes acoustic environment codes 512, 514, 516 and 518 corresponding respectively to acoustic environments 522, 524, 526 and 528. In various embodiments, acoustic environment codes 512, 514, 516 and 518 includes code 1, code 2, code 3 and code N, respectively. In various embodiments, codes 1-N are digital signals having a pre-determined arrangement of bits that are transmitted either serially or in parallel by beacon device 110 and received by any of hearing assistance devices 210, 310 and 410. In various embodiments, acoustic environment 522 can include the acoustic environment inside a stationary automobile. In various embodiments, acoustic environment 522 can include the acoustic environment inside a moving automobile. In various embodiments, acoustic environment 524 includes the acoustic environment in a room while the wearer of a hearing assistance device is performing a vacuuming function. In various embodiments, acoustic environment 526 includes the acoustic environment of an open space. In various embodiments, acoustic environment 526 includes the acoustic environment experienced by the wearer of a hearing assistance device in a country-side or a busy city street. In various embodiments, acoustic environment 528 includes the acoustic environment experienced by the wearer of a hearing assistance device in a lecture hall. Many other examples of acoustic environments can be represented by alternate codes to provide information to the hearing assistance device as to the particular environment that the hearing assistance device user will experience as the user enters that particular acoustic environment. The use of such acoustic environment codes eliminates the need for complex signal processing methods needed in hearing assistance devices to classify the environment in which the hearing assistance device is operating. In various embodiments, the hearing assistance device reads the acoustic environment code transmitted by the beacon device and accordingly sets the operating modes for the microphones within the hearing assistance device. In various embodiments, the hearing assistance device reads the acoustic environment code transmitted by the beacon device and uses appropriate signal processing methods based on the received acoustic environment code. In various embodiments, the acoustic environment codes/acoustic environment associations are pre-programmed in the hearing assistance device. For example, when detecting a "car" code the hearing assistance device should change its directional processing to assume sound sources of interest are not necessarily straight ahead and therefore can choose an omni-directional mode. In various embodiments, the acoustic environment codes are learned by the hearing assistance device. For example, the hearing assistance device would learn to associate regular user changes to hearing assistance device processing with an acoustic environment code being picked up while those changes are made.

In various embodiments, each of the acoustic environment codes stored in memory 112 is indicative of various different acoustic environments. In various embodiments, the transmitted wireless signals include data indicative of the acoustic environment of the location of beacon device 110. In various embodiments, the acoustic environments include, but are not limited to, the inside of a car, an empty room, a lecture hall, a room with furniture, open spaces such as in a country side, a sidewalk of a typical city street, inside a plane, a factory work environment, etc. In various embodiments, the acoustic environment codes are stored in register locations within memory 112. In some embodiments, memory 112 includes non-volatile flash memory.

Figure 6:
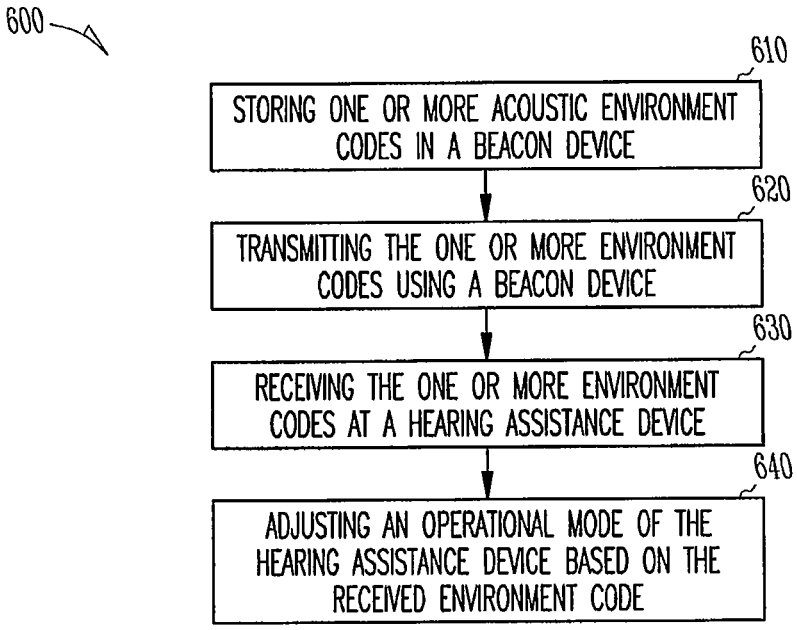
FIG. 6 illustrates a method of providing environment awareness for a hearing assistance device, according to one embodiment of the present subject matter.

FIG. 6 illustrates a flow chart of one embodiment of a method 600 for providing environment awareness in hearing assistance devices. At block 610, method 600 includes storing one or more acoustic environment codes in a beacon device. At block 620, method 600 includes transmitting the one or more environment codes using a beacon device. In various embodiments, transmitting the one or more environment codes comprises transmitting the one or more environment code at uniform intervals.

At block 630, method 600 includes receiving the one or more environment codes at a hearing assistance device. In various embodiments, receiving the one or more environment codes at a hearing assistance device comprises receiving an acoustic environment code when the hearing assistance device enters the particular acoustic environment identified by the acoustic environment code. In various embodiments, receiving the first acoustic environment code comprises receiving the first acoustic environment code when a user having the hearing assistance device enters an automobile, a plane, a railway car or a ship. In various embodiments, acoustic environments can include inside of a car, an empty room, a lecture hall, a room with furniture, open spaces such as in a countryside, a sidewalk of a typical city street, inside a plane, a factory work environment, in a room during vacuuming, watching a television, hearing the radio etc.

At block 640, method 600 includes adjusting an operational mode of the hearing assistance device based on the received environment code. In various embodiments, adjusting the operational mode of the hearing assistance device comprises switching between a first microphone and a second microphone. In various embodiments, switching between a first microphone and a second microphone comprises switching between a directional microphone and an omni-directional microphone.

In various embodiments, information is telemetered relating to signals sensed by the one or more sensors on the wireless beacon device. In such designs the information telemetered includes, but is not limited to, sensed signals, and/or statistical information about the sensed signals. Hearing assistance devices receiving such information are programmed to process the received signals to determine an environmental status. In such embodiments, the received information may be used by the hearing assistance system to determine the acoustic environment and/or to at least partially control operation of the hearing assistance device for better listening by the wearer.

The present subject matter includes hearing assistance devices, including, but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in-the-canal. It is understood that other hearing assistance devices not expressly stated herein may fall within the scope of the present subject matter.

This application is intended to cover adaptations and variations of the present subject matter. It is to be understood that the above description is intended to be illustrative, and not restrictive. The scope of the present subject matter should be determined with reference to the appended claims, along with the full scope of legal equivalents to which the claims are entitled.

What is claimed is:

1. A method comprising:

storing a plurality of acoustic environment codes in a portable beacon device, each of the plurality of acoustic environment codes associated with an acoustic environment;

sensing acoustic signals about the beacon device using a microphone in the beacon device;

storing the plurality of acoustic environment codes and acoustic environments in a hearing assistance device, wherein the hearing assistance device is configured to learn to associate acoustic environment codes with acoustic environments; and transmitting an acoustic environment code of the plurality of acoustic environment codes from the portable beacon device to the hearing assistance device adapted to be placed in or about an ear canal of a hearing impaired wearer, wherein the acoustic environment code is associated with an acoustic environment and sensed acoustic signals about the portable beacon device and is adapted for use in the hearing assistance device to adjust an operational mode of the hearing assistance device to provide improved hearing of the wearer in the acoustic environment.

2. The method of claim 1, wherein transmitting the acoustic environment code comprises transmitting the acoustic environment code at uniform intervals.

3. The method of claim 1, further comprising receiving a first acoustic environment code when the beacon device enters a first acoustic environment identified by the first acoustic environment code.

4. The method of claim 1, further comprising processing one or more sensor signals to identify an acoustic environment about the beacon device.

5. The method of claim 1, wherein adjusting the operational mode of the hearing assistance device comprises switching between a first microphone and a second microphone.

6. The method of claim 5, wherein switching between a first microphone and a second microphone comprises switching between a directional microphone and an omni-directional microphone.

7. The method of claim 1, further comprising receiving from a sensor of the beacon device a signal indicative of an acoustic environment about the beacon device.

8. The method of claim 7, wherein receiving includes receiving from a giant magneto restrictive sensor of the beacon device a signal indicative of an acoustic environment about the beacon device.

9. The method of claim 7, wherein receiving includes receiving from an anisotropic magneto restrictive sensor of the beacon device a signal indicative of an acoustic environment about the beacon device.

10. The method of claim 7, wherein receiving includes receiving from a micro-electro-mechanical system (MEMS) sensor of the beacon device a signal indicative of an acoustic environment about the beacon device.

11. The method of claim 7, processing the sensor signal and correlating the acoustic environment code of the one or more acoustic environment codes with the processed sensor signal.

12. A method, comprising:

wirelessly receiving an acoustic environment code associated with an acoustic environment and associated with sensed acoustic signals about a portable beacon device, the portable beacon device including a microphone to sense acoustic signals, wherein the acoustic environment code is received from the portable beacon device using a hearing assistance device adapted to be worn in or about an ear canal of a hearing impaired wearer, wherein the acoustic environment code is one of a plurality of acoustic environment codes and acoustic environments pre-programmed in the hearing assistance device, wherein the hearing assistance device is configured to learn to associate acoustic environment codes with acoustic environments; and upon receipt of the acoustic environment code, processing the acoustic environment code and adjusting an operational parameter of the hearing assistance device to provide improved hearing of the wearer in the acoustic environment.

13. The method of claim 12, wherein wirelessly receiving the acoustic environment code from the beacon device using the hearing assistance device includes wirelessly receiving the acoustic environment code from the beacon device using a cochlear implant.

14. The method of claim 12, wherein wirelessly receiving the acoustic environment code from the beacon device using the hearing assistance device includes wirelessly receiving the acoustic environment code from the beacon device using a hearing aid.

15. The method of claim 14, wherein wirelessly receiving the acoustic environment code from the beacon device using the hearing aid includes wirelessly receiving the acoustic environment code from the beacon device using a behind-the-ear (BTE) hearing aid.

16. The method of claim 14, wherein wirelessly receiving the acoustic environment code from the beacon device using the hearing aid includes wirelessly receiving the acoustic environment code from the beacon device using an in-the-ear (ITE) hearing aid.

17. The method of claim 14, wherein wirelessly receiving the acoustic environment code from the beacon device using the hearing aid includes wirelessly receiving the acoustic environment code from the beacon device using an in-the-canal (ITC) hearing aid.

18. The method of claim 14, wherein wirelessly receiving the acoustic environment code from the beacon device using the hearing aid includes wirelessly receiving the acoustic environment code from the beacon device using a completely-in-the-canal (CIC) hearing aid.

19. The method of claim 14, wherein wirelessly receiving the acoustic environment code from the beacon device using the hearing aid includes wirelessly receiving the acoustic environment code from the beacon device using a receiver-in-the-canal (RIC) hearing aid.

20. The method of claim 12, wherein adjusting an operational parameter of the hearing assistance device includes adjusting at least one of volume control, tone control, directionality, and selective signal input.

21. The method of claim 1, wherein transmitting the acoustic environment code comprises wirelessly transmitting the acoustic environment code.

22. The method of claim 21, wherein wirelessly transmitting the acoustic environment code includes wirelessly transmitting a digital signal.

23. The method of claim 21, wherein wireless transmitting the acoustic environment code includes using an antenna in the beacon device.

24. The method of claim 23, wherein using the antenna includes using one or more of a monopole antenna, a dipole antenna, a patch antenna, a flex antenna, a loop antenna or a waveguide antenna.

25. The method of claim 12, wherein wirelessly receiving the acoustic environment code includes wirelessly receiving a digital signal.

26. The method of claim 12, wherein wirelessly receiving the acoustic environment code includes receiving the acoustic environment code using an antenna.

27. The method of claim 26, wherein using the antenna includes using one or more conductors in a cable assembly as the antenna, the cable assembly configured to connect hearing assistance electronics.

* * * * *